US010507564B2

(12) United States Patent
Schmueck

(10) Patent No.: US 10,507,564 B2
(45) Date of Patent: Dec. 17, 2019

(54) METHOD FOR THE PRODUCTION OF A DRESSING TOOL FOR A GRINDING TOOL

(71) Applicants: KAPP Werkzeugmaschinen GmbH, Coburg (DE); NILES Werkzeugmaschinen GmbH, Berlin (DE)

(72) Inventor: Friedrich Schmueck, Ebersdorf (DE)

(73) Assignees: KAPP WERKZEUGMASCHINEN GMBH, Coburg (DE); NILES WERKZEUGMASCHINEN GMBH, Berlin (DE)

( * ) Notice: Subject to any disclaimer, the term of this patent is extended or adjusted under 35 U.S.C. 154(b) by 233 days.

(21) Appl. No.: 15/616,006

(22) Filed: Jun. 7, 2017

(65) Prior Publication Data

US 2017/0355063 A1 Dec. 14, 2017

(30) Foreign Application Priority Data

Jun. 8, 2016 (DE) ..... 10 2016 006 951

(51) Int. Cl.
*B24B 53/075* (2006.01)
*B24B 53/085* (2006.01)
(Continued)

(52) U.S. Cl.
CPC ..... *B24B 53/075* (2013.01); *B24B 53/085* (2013.01); *B24B 53/14* (2013.01); *B24D 18/00* (2013.01)

(58) Field of Classification Search
CPC ..... B24D 18/00; B24B 53/025; B24B 53/085; B24B 53/14; B24B 53/075
(Continued)

(56) References Cited

U.S. PATENT DOCUMENTS 2,988,860 A * 6/1961 Sohl ..... B24D 5/04 451/546
3,491,740 A * 1/1970 Kohlstrunk ..... G11C 11/412 125/11.03

(Continued)

FOREIGN PATENT DOCUMENTS

CH 684249 A5 8/1994
DE 10156661 A1 6/2003

(Continued)

*Primary Examiner* — Robert A Rose
(74) *Attorney, Agent, or Firm* — Lucas & Mercanti, LLP

(57) ABSTRACT

A method for the dressing of a multi-thread grinding worm by a dressing roll, wherein the grinding worm has at least two screw channels which are arranged parallel to another, which screw channels extend helically around an axis of the grinding worm and wherein the dressing roll has at least two adjacent dressing profiles which are arranged along an axis of the dressing roll, wherein the dressing profiles of the dressing roll are guided simultaneously through adjacent screw channels of the grinding worm during the dressing of the grinding worm. To improve the precision of the dressing the method includes the steps: a) execution of a first partial dressing process at which the dressing profiles of the dressing roll are guided simultaneously through first adjacent screw channels of the grinding worm; b) execution of at least one second partial dressing process at which the dressing profiles of the dressing roll are guided simultaneously through second adjacent screw channels of the grinding worm, wherein the second adjacent screw channels are, compared with step a), offset in the direction of the axis of the grinding worm by at least one screw channel of the grinding worm.

13 Claims, 3 Drawing Sheets

(51) Int. Cl.
*B24B 53/14* (2006.01)
*B24D 18/00* (2006.01)

(58) Field of Classification Search
USPC ..... 451/541, 443, 47, 546, 547; 125/11.01
See application file for complete search history.

(56) References Cited

U.S. PATENT DOCUMENTS

| | | | | |
|---|---|---|---|---|
| 3,913,278 | A * | 10/1975 | Kokoras | B24B 19/005 451/547 |
| 4,925,457 | A | 5/1990 | Dekok et al. | |
| 5,339,794 | A * | 8/1994 | Thyssen | B24B 53/085 125/11.04 |
| 5,885,149 | A | 3/1999 | Gillet et al. | |
| 6,200,360 | B1 | 3/2001 | Imai et al. | |
| 2002/0182401 | A1 | 12/2002 | Lawing | |
| 2009/0227182 | A1* | 9/2009 | Breith | B23F 23/1225 451/5 |
| 2014/0273773 | A1 | 9/2014 | Chou et al. | |
| 2014/0302757 | A1 | 10/2014 | Inamori et al. | |

FOREIGN PATENT DOCUMENTS

| | | | |
|---|---|---|---|
| DE | 69034066 | T2 | 3/2004 |
| JP | H04244377 | A | 9/1992 |
| WO | 2007000831 | A1 | 1/2007 |

* cited by examiner

METHOD FOR THE PRODUCTION OF A DRESSING TOOL FOR A GRINDING TOOL

CROSS-REFERENCE TO RELATED APPLICATIONS

The present application claims priority of DE 10 2016 006 951.1, filed Jun. 8, 2016, the priority of this application is hereby claimed and this application is incorporated herein by reference.

BACKGROUND OF THE INVENTION

The invention relates to a method for the production of a dressing tool for a grinding tool, preferably for a grinding worm, wherein the dressing tool comprises at least one, preferably ring-shaped designed projection which extends radially.

At the machining especially of gearings with generative tools normally a dressable multi-thread grinding worm is used. The dressing of the grinding worm takes place in turn with a single- or multi-groove dressing roll. The present invention relates a method for the production of such a dressing tool. Preferably, thereby multi-groove full profile rolls are provided which can be used for an efficient dressing of grinding worms.

A method of the generic kind is described in DE 101 56 661 A1. A similar method is disclosed in JP H04 244 377 A. Other solutions are shown in US 2002/0182401 A1 and in US 2014/0273773 A1.

To produce such a generic full profile roll a shaped ring is produced according to another method which is provided with the workpiece-specific profile. On this profile a diamond or nickel layer is deposited mostly in a galvanic process which layer—bonded on a core—finally results after different further process steps in the above mentioned dressing tool.

The production process is thereby very laborious. Often, already for the creation of the diamond or nickel layer the shaped ring is located in a galvanic bath up to three weeks.

Thereby it was found that the so created profile of the dressing tool has sometimes defects which can be traced back to different reasons. Namely the outer flanks of the profile "folds open" outwards which is explained by tensions in the structure. Furthermore, also thermal tensions are noticed which lead to defects in the profile.

So it results that by deformations of the nickel layer, especially generated by inner tensions and mechanical strain, the precision of the profile is influenced. So, in detrimental manner prior to the use of the dressing tool a respective post-processing is necessary to eliminate the defects.

SUMMARY OF THE INVENTION

Thus, it is an object of the invention to design a generic method in such a manner that the profile of the produced dressing tool corresponds as good as possible to the ideal contour; so, profile defects of the dressing tool should be eliminated. Especially it should be made sure that the deformation of the nickel layer remains as small as possible. Accordingly the dressing tool should have a precise geometry as much as possible.

The solution of this object by the invention proposes a method which comprises the steps:

a) Production of a shaped ring, which comprises a number of recesses at a radial inner area which number corresponds to the number of projections and which recesses are designed congruent to the projections;

b) Placing of abrasive material, especially of diamond powder, in the recesses;

c) Creation of a chemical or electro-chemical coating in the recesses so that the abrasive material is fixed in the region of the surface of the recesses;

d) Removal of the shaped ring, to obtain the so arose dressing tool;

wherein a support element is placed prior or during step b) or prior or during step c) in the region of the radial inner area which support element is material joined integrally during step c) at least partially with the arising dressing tool by the coating.

As support element preferably an open lattice structure with openings is used so that the radial inner area is not radially closed by the support element. Rather the exchange of the electrolyte which is required for the production of the coating is so not or barely hindered by the support element.

The support element extends preferably along a width which corresponds between 90% and 100% of the width of the dressing tool.

As support element preferably a structure is used which comprises a plurality of rings which run in circumferential direction of the radial inner area, wherein the rings are connected by means of cross-beams, wherein the cross-beams run in axial direction of the dressing tool. The rings and/or the cross-beams consist thereby preferably of metal. The rings and/or the cross-beams comprise preferably a circular cross section. Insofar a wire with circular cross section can be used as base materials for the production of the support element.

The number of rings is preferably the number of projections plus one. Thus, in this case a ring is located on both sides of each recess of the shaped ring.

The rings and the cross-beams can be connected prior to their use or prior the location in the shaped ring with another by material bonding; here, especially welding or soldering is taken in consideration.

The shaped ring can rotates around its axis at least temporary during the execution of above step c). So it can be effected that the abrasive material (especially the diamond powder) is held so long in the recesses of the shaped ring by means of the centrifugal force till it is fixed at the surface of the recess by the (especially galvanic) coating process.

The removal of the shaped ring according to above step d) takes place preferably by machining of the shaped ring, especially by turning.

Thus, one aspect of the present invention is that during the preferably galvanic coating process a strutting (i. e. the support element) is integrated into the forming nickel layer. This strutting counteracts to a possible deformation and prevents the same. As mentioned a galvanic coating (electrochemical deposition; "galvanic nickel") is preferred. However, in general also a chemical coating can be provided ("chemical nickel"). Of course, other coating materials are possible, wherein nickel is preferred.

Thereby, the material of the support element is selected in such a manner that it can be integrated into the nickel layer without problems and thereby deforms as little as possible. Thereby, it is paid attention to the fact that the deposited galvanic layer does not deform. The support element is galvanically connected with the galvanic layer which contains already the abrasive particles which galvanic layer is if applicable prior deposited (in connection with a first fixing of the abrasive material in the shaped ring).

Accordingly, thus the design of the support element is chosen in such a manner that it counteracts to a possibly acting deformation tension.

Thereby it must be considered that the support element is so designed and so dimensioned respectively that an equal deposition of the galvanic layer can be obtained also after placing of the support element. Namely, the support element must not form a shield; the exchange of the electrolyte must be ensured.

Thereby, the support element can be introduced prior or after the application of diamond (i. e. prior or after the introduction of abrasive material onto the surface of the above mentioned recesses).

By the proposed design of the support element it is made sure that the support element does not cause any change of the grain density (number of grains on the area) and no grain defects during electroplating.

The proposed invention is used especially for full profile rolls or at the galvanic negative-coating.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
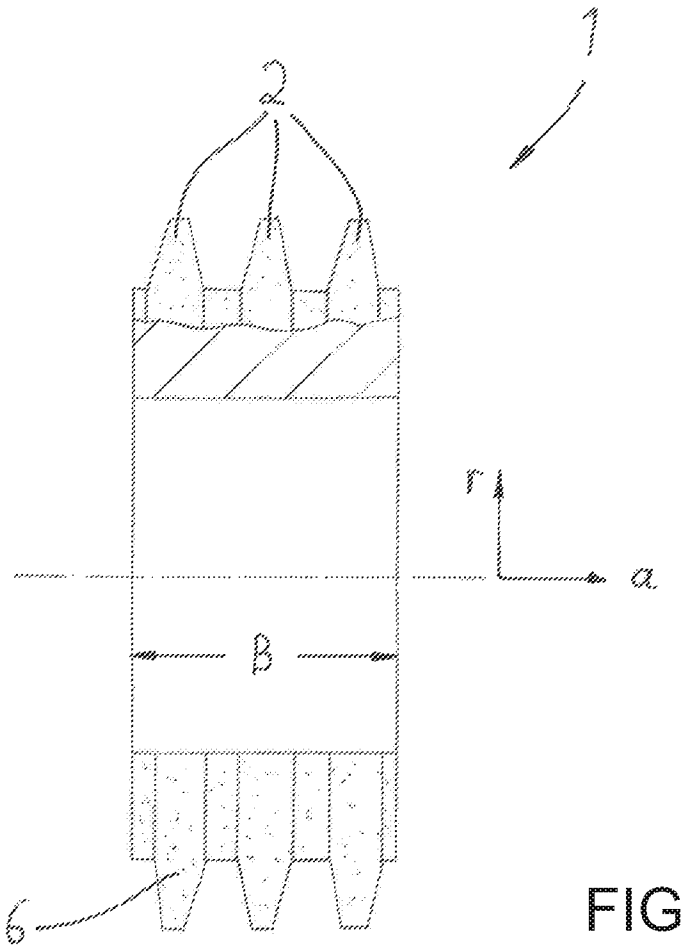
FIG. 1 shows the side view in partial radial cross section of a dressing tool being a three-groove full-profile roll.

In FIG. 1 a dressing tool 1 being a dressing roll is shown. The dressing tool 1 consists of a rotationally symmetric part which comprises a direction of the axis a as well as a radial direction r. The dressing tool 1 has a width B in axial direction.

In the embodiment the dressing tool 1 has three ring-shaped projections 2 which run in circumferential direction and which extend in radial direction r. Those projections 2 are provided with abrasive material 6 in the form of diamond powder (with corresponding grain size; dependent from the grinding tool to be dressed) so that with the dressing tool 1 a grinding worm can be dressed. This process is known as such and needs not to be explained here in detail.

Figure 2:
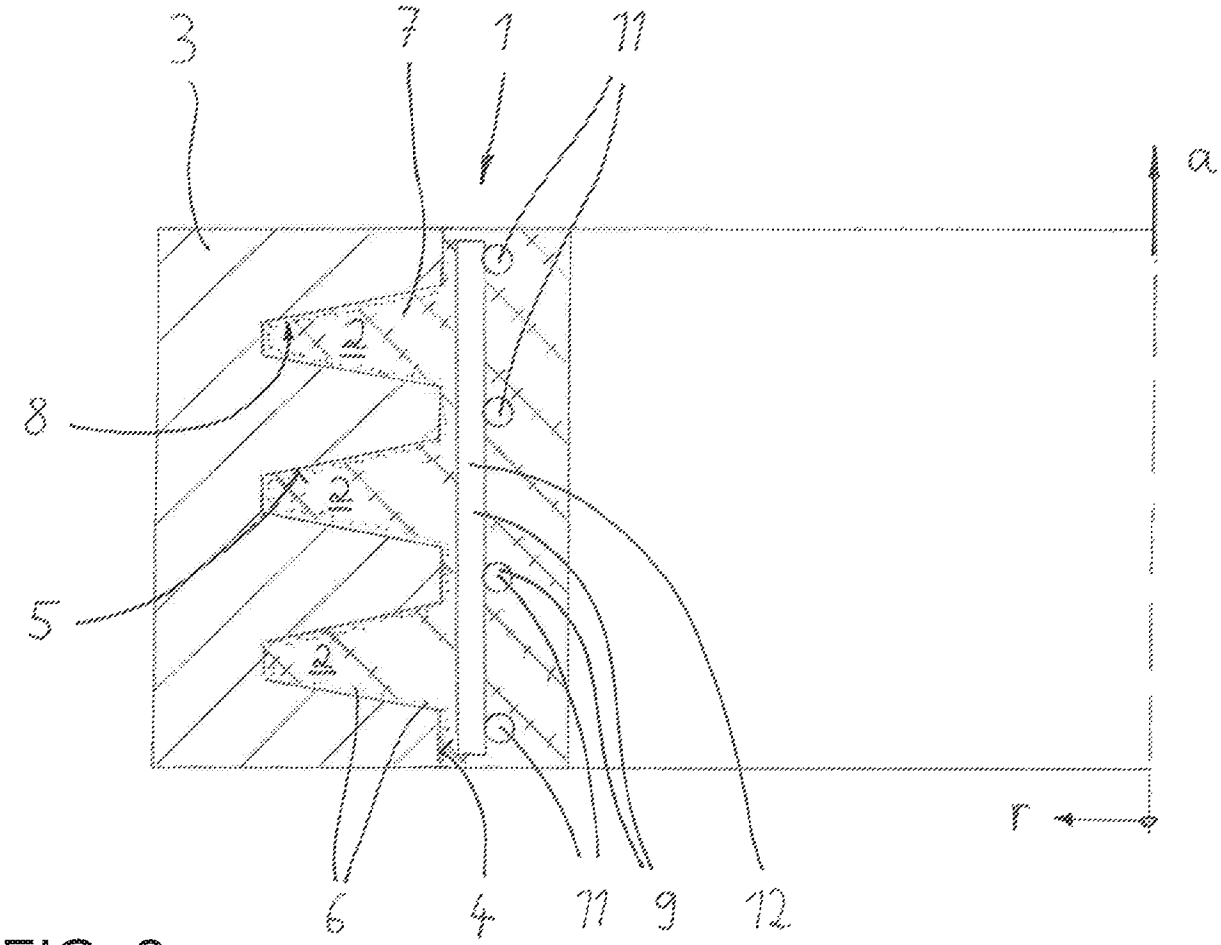
FIG. 2 shows the radial cross section of a shaped ring with the dressing tool which is produced by means of the same and FIG. 3 shows the perspective depiction of a part of a support element which is embedded in the dressing tool.

The production of such a dressing tool 1 is depicted in FIG. 2. Central element for the production is a shaped ring 3 which has a substantial hollow-cylindrical shape. At a radial inner area 4 of the shaped ring 3 recesses 5 are machined (i. e. ground with high precision) which are congruent with the projections 2 (negative method).

At first, in the recesses 5 abrasive material 6 (diamond powder) is placed at the production of the dressing tool 1 so that the surface 8 of the recesses 5 is at least partially covered or faced with the abrasive material 6.

Subsequently the creation of a galvanic coating 7 takes place so that the abrasive material 6 is fixed at the surface 8 of the recess 5 and is available for the later dressing process. In FIG. 2 a situation is depicted at which the galvanic coating process is already substantially completed, i. e. the region of the recesses 5 is already filled with the material of the coating and furthermore has reached a region which extends radial inwards.

It is essentially that prior to the production of the complete coating 7 a support element 9 is introduced in the shaped ring 3 which is at least partially integrated into the forming dressing tool 1 by the galvanic coating process. In FIG. 2 it can be seen that the support element 9 was integrated completely into the coating material, i. e. it is surrounded by the same. So, the support element is connected material joined with the arising dressing tool 1. But it is also possible that after the termination of the coating process the supporting element 9 is not completely surrounded by the coating material.

After the status is reached as depicted in FIG. 2 the shaped ring 3 is removed which can be take place by a machining process. So the dressing tool 1 is available for its intended use.

Figure 3:
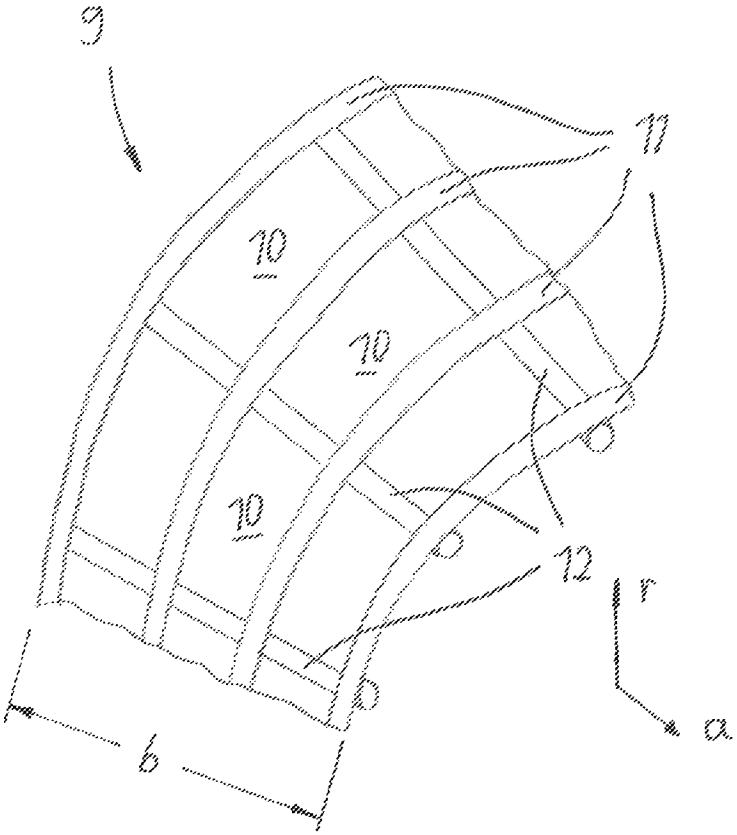

In FIG. 3 the employed support element 9 is shown again in perspective view. Here, it can be seen that the support element 9 has a width b which corresponds substantially to the width of the dressing tool 1 or is marginally smaller than the mentioned width B.

The support element 9 consists of several (in the embodiment: of four) rings 11 which are connected (especially by soldering) by cross-beams 12 with another which are equidistantly distributed around the circumference. Preferably 20 to 80 cross-beams 12 are arranged around the circumference. As can be seen in FIG. 3, a result are openings 10 which allow that during the coating process electrolyte can penetrate through the support element 9 and thus the electroplating process is not or barely hindered by the support element 9.

Thus, in the present embodiment the support element (respectively support lattice) is designed as lattice structure made of longitudinal and transversal rods which structure is tensed in the shaped ring. The dimensions of the lattice structure are adapted to the contour which has to be supported. The support element is thereby so positioned in the shaped ring that the total width of the grooves (recesses) is covered and the support element is completely embedded into the nickel layer.

It should be mentioned that the coating process, which is carried out normally as an electroplating process, takes place beneficially in two steps:

In a first step the abrasive material 6 which is located in the recesses 5 is fixed by a first coating with nickel in a first working station, wherein the shaped ring rotates so that the abrasive material 6 is held by the centrifugal force in the region of the surface 8 of the recesses 5.

When the abrasive material 6 is then fixed so far then the coating 7 can be carried out in the finally desired range in a second working station. However, before this takes place the support element is introduced in the shaped ring 3 and is material joined embedded by the coating process.

While specific embodiments of the invention have been shown and described in detail to illustrate the inventive principles, it will be understood that the invention may be embodied otherwise without departing from such principles.

I claim:

1. A method for the production of a dressing tool for a grinding tool, wherein the dressing tool comprises at least one projection which extends radially, wherein the method comprises the steps:

a) producing a shaped ring, which comprises a number of recesses at a radial inner area which number corresponds to a number of projections and which recesses are designed congruent to the projections;

b) placing abrasive material in the recesses;

c) creating a chemical or electro-chemical coating in the recesses so that the abrasive material is fixed in a region of the surface of the recesses;

d) removing the shaped ring, to obtain the so arose dressing tool;

wherein a support element is placed prior to or during step b) or prior to or during step c) in a region of the radial inner area, which support element is materially joined integrally during step c) at least partially with the arising dressing tool by the coating, and wherein the shaped ring rotates around its axis at least temporarily during the execution of step c).

2. The method according to claim 1, wherein as support element an open lattice structure with openings is used so that the radial inner area is not radially closed by the support element.

3. The method according to claim 1, wherein the support element extends along a width which corresponds to between 90% and 100% of the width of the dressing tool.

4. The method according to claim 1, wherein as support element a structure is used which comprises a plurality of rings which run in a circumferential direction of the radial inner area, wherein the rings are connected by cross-beams, wherein the cross-beams run in an axial direction of the dressing tool.

5. The method according to claim 4, wherein at least one of the rings and the cross-beams consist of metal.

6. The method according to claim 4, wherein at least one of the rings and the cross-beams comprise a circular cross section.

7. The method according to claim 4, wherein the number of rings is the number of projections plus one.

8. The method according to claim 4, wherein the rings and the cross-beams are connected with another by material bonding.

9. The method according to claim 1, wherein the removing of the shaped ring according to step d) takes place by machining the shaped ring.

10. The method according to claim 1, wherein the dressing tool is for a grinding worm.

11. The method according to claim 1, wherein the projection is a ring-shape designed projection.

12. The method according to claim 1, wherein placing of step b) includes placing diamond powder in the recesses.

13. The method according to claim 8, wherein the rings and the cross-beams are connected with another by welding or by soldering.

* * * * *